US010650990B2

(12) United States Patent
Okada

(10) Patent No.: US 10,650,990 B2
(45) Date of Patent: May 12, 2020

(54) ROTARY SWITCH

(71) Applicant: ALPHA CORPORATION, Yokohama-shi, Kanagawa (JP)

(72) Inventor: Takahiro Okada, Yokohama (JP)

(73) Assignee: ALPHA CORPORATION, Yokohama-shi, Kanagawa (JP)

( * ) Notice: Subject to any disclaimer, the term of this patent is extended or adjusted under 35 U.S.C. 154(b) by 0 days.

(21) Appl. No.: 15/815,998

(22) Filed: Nov. 17, 2017

(65) Prior Publication Data

US 2018/0082806 A1 Mar. 22, 2018

Related U.S. Application Data

(63) Continuation of application No. PCT/JP2016/065074, filed on May 20, 2016.

(30) Foreign Application Priority Data

May 21, 2015 (JP) ..... 2015-103731

(51) Int. Cl.
*H01H 25/06* (2006.01)
*H01H 19/08* (2006.01)
(Continued)

(52) U.S. Cl.
CPC ..... *H01H 19/08* (2013.01); *H01H 19/02* (2013.01); *H01H 19/14* (2013.01); *H01H 19/58* (2013.01);
(Continued)

(58) Field of Classification Search
CPC ..... H01H 19/11; H01H 1/2041; H01H 25/06; H01H 19/56; H01H 19/08; H01H 19/58; H01H 27/063; H01H 19/02; H01H 19/14; H01H 1/44; H01H 1/365
USPC ..... 200/571, 570, 11 R, 564, 336
See application file for complete search history.

(56) References Cited

U.S. PATENT DOCUMENTS 3,683,133 A 8/1972 Heap
6,096,988 A 8/2000 Tsukamoto et al.
(Continued)

FOREIGN PATENT DOCUMENTS

CN A-101111913 1/2008
DE A1-3219853 12/1983
(Continued)

OTHER PUBLICATIONS

International Search Report dated Aug. 9, 2016 for PCT/JP2016/065074 [English translation].
(Continued)

*Primary Examiner* — Ahmed M Saeed
(74) *Attorney, Agent, or Firm* — Faegre Drinker Biddle & Reath LLP

(57) ABSTRACT

A rotary switch includes a rotation movable portion, a movable conductor held in the rotation movable portion, a base portion, a power supply terminal held in the base portion, and a plurality of fixed contacts held in the base portion. The fixed contact and the power supply terminal are connected and disconnected via the movable conductor by a rotational operation of the rotation movable portion. The power supply terminal is disposed at a rotation center position of the rotation movable portion. The plurality of fixed contacts are disposed on a plurality of concentric circles having different diameter dimensions around the power supply terminal.

9 Claims, 5 Drawing Sheets

(51) Int. Cl.

| | |
|---|---|
| ***H01H 19/02*** | (2006.01) |
| ***H01H 27/06*** | (2006.01) |
| ***H01H 19/58*** | (2006.01) |
| ***H01H 19/14*** | (2006.01) |
| *H01H 1/36* | (2006.01) |
| *H01H 1/44* | (2006.01) |

(52) U.S. Cl.
CPC ..... *H01H 27/063* (2013.01); *H01H 1/365* (2013.01); *H01H 1/44* (2013.01)

(56) References Cited

U.S. PATENT DOCUMENTS

| | | | | |
|---|---|---|---|---|
| 2006/0113170 | A1* | 6/2006 | Rochon ..... | H01H 25/041 200/5 R |
| 2008/0121502 | A1 | 5/2008 | Naganuma et al. | |

FOREIGN PATENT DOCUMENTS

| | | | |
|---|---|---|---|
| DE | U1-8904537 | | 9/1989 |
| FR | A5-2076976 | | 10/1971 |
| JP | S51-17582 | A | 2/1976 |
| JP | H08-201112 | A | 8/1996 |
| JP | H09-204838 | A | 8/1997 |
| JP | H11-86680 | A | 3/1999 |
| JP | 2012-109169 | A | 6/2012 |

OTHER PUBLICATIONS

International Search Report/Written Opinion dated Aug. 9, 2016 for PCT/JP2016/065074 [non-English language].

CN Office Action dated Sep. 5, 2018 in Chinese Appl. No. 201680029393.6 (with attached English-language translation).

Extended European Search Report dated Nov. 23, 2018 in corresponding European patent application 16796601.9 (7 pages).

* cited by examiner

ROTARY SWITCH

CROSS REFERENCE TO RELATED APPLICATIONS

This application is a continuation of PCT application No. PCT/JP2016/065074, which was filed on May 20, 2016 based on Japanese Patent Application (No. 2015-103731) filed on May 21, 2015, the contents of which are incorporated herein by reference.

BACKGROUND OF THE INVENTION

Field of the Invention

The present disclosure relates to a rotary switch.

Description of Related Art

Patent Document 1 (JP-A-2012-109169) discloses a rotary switch which performs switching by connecting and disconnecting conduction between a power supply terminal and a fixed contact by rotating a movable contact. In Patent Document 1, the rotary switch has a fixed contact base and a rotor that holds one movable contact plate that is rotatable relative to the fixed contact base.

An arcuate power supply terminal which is disposed around a rotation center of the rotor and has a predetermined arcuate length, and a plurality of fixed contacts which are disposed on the same circumstance as the power supply terminal and on concentric circles different in diameter dimension from the power supply terminal are disposed in the fixed contact base. A corresponding fixed contact and the power supply terminal are connected to each other by causing the movable contact on the movable contact plate, which is constantly in contact with the power supply terminal, to be in contact with a predetermined fixed contact.

In the rotary switch of Patent Document 1, the power supply terminal is disposed around the rotation center of the rotor and it is necessary to maintain a contact state even when the movable contact is in contact with any fixed contact. Therefore, the arcuate length becomes longer and a disposition space of the fixed contacts disposed on the same circumstance becomes narrower.

On the other hand, abrasion powder is generated due to abrasion of the contacts in a large number of contact operations or separation operations of the movable contact to the fixed contacts. If generated abrasion powder scatters between the fixed contacts, deterioration of an insulation property is caused and a switch connection and disconnection performance is deteriorated. In particular, the fixed contact may be often formed to be elongated in a circumferential direction due to requirements such as absorption of an error of a rotation angle of the rotor, stabilization of a contact resistance, or contact cleaning at the time of use under high current specifications. Therefore, an interval between adjacent fixed contacts becomes narrower and the insulation property decreases.

[Patent Document 1] JP-A-2012-109169

SUMMARY OF INVENTION

Technical Problem

One or more embodiments provide a rotary switch in which a connection and disconnection performance does not deteriorate even when used for a long period of time.

According to the disclosure, there is provided a rotary switch 6 including a movable conductor 2 that is held in a rotation movable portion 1; a power supply terminal 4 that is held in a base portion 3; and a fixed contact 5. The fixed contact 5 and the power supply terminal 4 are connected and disconnected via the movable conductor 2 by a rotational operation to the rotation movable portion 1. The power supply terminal 4 is disposed at a rotation center position of the rotation movable portion 1. A plurality of fixed contacts 5 are disposed on a plurality of concentric circles having different diameter dimensions around the power supply terminal 4.

In the disclosure, the power supply terminal 4 is disposed at a center portion on the base portion 3 and the fixed contacts 5 are disposed on the plurality of concentric circles so as to surround the power supply terminal 4. The power supply terminal 4 is disposed at the rotation center position of the rotation movable portion 1 and thereby it is possible to sufficiently secure a space for arrangement of the fixed contacts 5 at a peripheral edge thereof.

In addition, the plurality of fixed contacts 5 are disposed on the plurality of concentric circles of which the diameter dimensions are different and thereby it is possible to cut off a relationship between a switching angle of the fixed contact 5 by the rotation movable portion 1 and an angle between the fixed contacts 5. For example, even in a case where the switching angle of the fixed contact 5 by the rotation movable portion 1 is small, the adjacent fixed contacts 5 are disposed on the concentric circles of which the diameter dimensions are different and thereby it is possible to increase an interval between the fixed contacts 5.

In the disclosure, the fixed contacts 5 can be disposed on a sufficient arrangement space with a wide angle between the fixed contacts 5 regardless of timing of switching. Therefore, it is possible to secure a sufficient insulating space between all the fixed contacts 5 and to use the fixed contacts 5 for a long period of time.

Here, in the rotary switch of the disclosure, the rotary switch 6 may be configured such that a movable contact 7, which is in contact with or separated from only the corresponding fixed contact 5 in accordance with the rotation of the rotation movable portion 1, is provided in the movable conductor 2.

In the disclosure, the number of the movable contacts 7 of the movable conductor 2 is set to the same as the number of the fixed contacts 5 and each of the movable contacts 7 is used only for connection and disconnection of the corresponding fixed contact 5. As a result, the number of times of contact or separation between each of the movable contacts 7 and the fixed contact 5 is uniform at all the movable contacts 7 and the fixed contacts 5. Therefore, an abrasion amount of a contact due to sliding contact is uniform entirely and it is possible to prevent an entire product service life from being shortened due to a progress of abrasion of a specific contact.

Here, in the rotary switch of the disclosure, the rotary switch 6 may be configured such that a concave portion 8 may surround each of the fixed contacts 5 and is provided in the base portion 3.

In the disclosure, the fixed contact 5 is separated by the concave portion 8, and abrasion powder generated by a contact operation and a separation operation is dropped and collected within the concave portion 8. Therefore, insulation performance between the fixed contacts 5 is reliably maintained.

Here, in the rotary switch of the disclosure, the rotary switch 6 may be configured such that a plurality of the movable conductors 2 including a power supply contact 9 which is in pressed contact with the power supply terminal 4 at one end portion and the single movable contact 7 at the other end portion in the rotation movable portion 1 is movably held independently of each other.

As illustrated in an example of the related art, it is possible to form a plurality of movable contacts 7 in one plate-like movable conductor 2. However, as described in the disclosure, if the movable contacts 7 are formed in the single movable conductor 2 and the plurality of movable conductors 2 are held in the rotation movable portion 1, the displacement on the movable conductor 2 basis is possible. Therefore, it is possible to optimally maintain a pressure contact state between the corresponding fixed contact 5 and the movable contact 7 without being influenced by other contact states.

In the disclosure, even in a case where abrasion conditions are severe and abrasion progresses, since a specific fixed contact 5 or the movable contact 7 can be adjusted on a contact-by contact basis, reliable contact operation and the separation operation are guaranteed for a long period of time.

In this case, in a case where the movable contact 7 has a predetermined length and each of the fixed contacts 5 configures the rotary switch 6 formed in a linear shape, a contact point of the movable contact 7 relative to the fixed contact 5 moves in a longitudinal direction in accordance with the movement of the movable contact 7. Therefore, the contact is automatically cleaned and a suitable contact state is guaranteed.

SUMMARY

One or more embodiments provide a rotary switch which increase an interval between all the fixed contacts. Therefore, it is possible to reliably prevent insulation failure due to use for a long period of time or the like, and to maintain good contact performance and separation performance.

DETAILED DESCRIPTION

Figure 1:
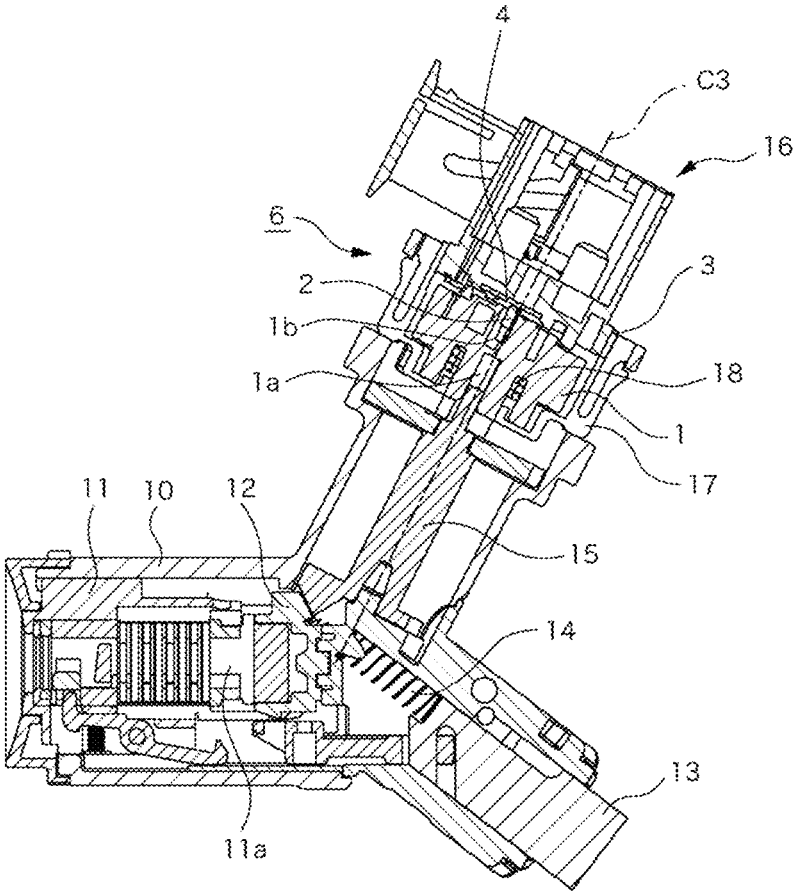
FIG. 1 is a sectional view illustrating a steering lock device according to an embodiment.

A rotary switch 6 of the disclosure configured as an ignition switch used for a steering lock device is illustrated in FIGS. 1 to 8. The steering lock device of the embodiment has a cylinder lock 11 accommodated in a housing 10 and a cam member 12 that is connected to a terminal end of a plug 11*a* of the cylinder lock 11, and is fixed to a steering column (not illustrated).

A lock piece 13, which is moved between a lock position projecting to an inside of the steering column and an unlock position accommodated in an inside of the housing by advancing and retreating in a direction intersecting a rotation shaft of the cam member 12 at a predetermined angle, is mounted on the housing 10. The lock piece 13 is urged in a direction of the lock position by a compression spring 14 and when the plug 11*a* of the cylinder lock 11 is operated to rotate from a lock rotation position, the plug 11*a* of the cylinder lock 11 moves from the lock position engaged with a steering shaft to the unlock position released from the engagement, and an operation of the steering shaft can be performed.

In addition, an ignition switch 6, which performs conduction between predetermined terminals in accordance with the rotation of the plug 11*a* and changes a power supply state to an electric system of the vehicle, is connected to the housing 10. In order to transmit the rotational operation of the plug 11*a* to the ignition switch 6, a connecting bar 15, which meshes with the cam member 12 and rotates together with the cam member 12, is disposed in the housing 10.

The ignition switch 6 has a switch case 16 including a base portion 3 having a circular shape in plan view, a rotation movable portion 1 that is rotatable around a center (C3) of the base portion 3 with respect to the switch case 16, and a switch cover 17 that is connected to the switch case 16 and covers the rotation movable portion 1. A power supply terminal 4 and fixed contacts 5 are disposed in the base portion 3 formed of an insulating material in a state of being exposed on a rotation boundary surface with the rotation movable portion 1 (see FIG. 2).

The power supply terminal 4 and each of the fixed contacts 5 are drawn out to a connector fastening member 16*a* via wires wired in the switch case.

The rotation movable portion 1 is formed of an insulating material and a connecting hole la for connection with the connecting bar 15 is formed at one end portion thereof. The rotation movable portion 1 is urged only when returning from a START position to an ON position by a torsion spring 18 and moderately rotates at an appropriate connecting operation angle by fitting a click ball 20 urged by a click spring 19 into a groove of an inner wall of the switch cover 17.

Furthermore, a plate-like movable conductor 2 having a predetermined plate thickness is accommodated in the rotation movable portion 1 so that a plate thickness surface faces the base portion 3. The movable conductor 2 has a V-shaped protruding power supply contact 9 at one end and a flat movable contact 7 at the other end, and a tip of the power supply contact 9 is chamfered in order to keep a contact state good when the power supply contact 9 is in pressed contact with the power supply terminal 4 of the base portion 3.

Figure 2:
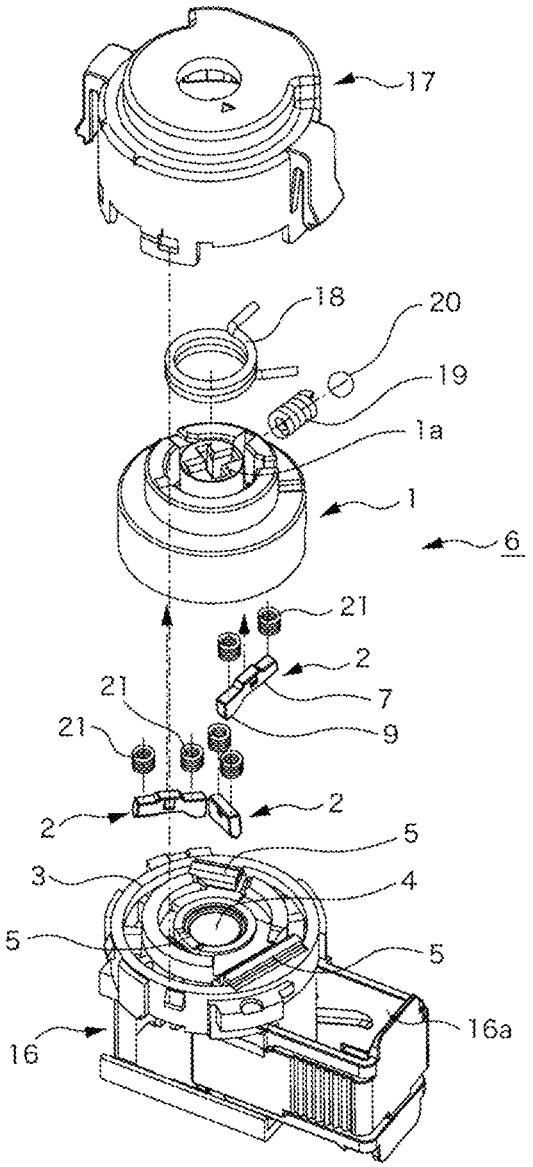
FIG. 2 is an exploded perspective view of a rotary switch.

As illustrated in FIG. 1, the movable conductor 2 formed as described above is accommodated in an accommodation groove 1*b* formed in the rotation movable portion 1, is movable in a direction along a rotation axis (C3), and is urged to a surface side of the base portion 3 by compression springs 21 which are accommodated in the rotation movable portion 1 and press back surfaces of the power supply contact 9 and the movable contact 7 (see FIG. 2).

Figure 3:
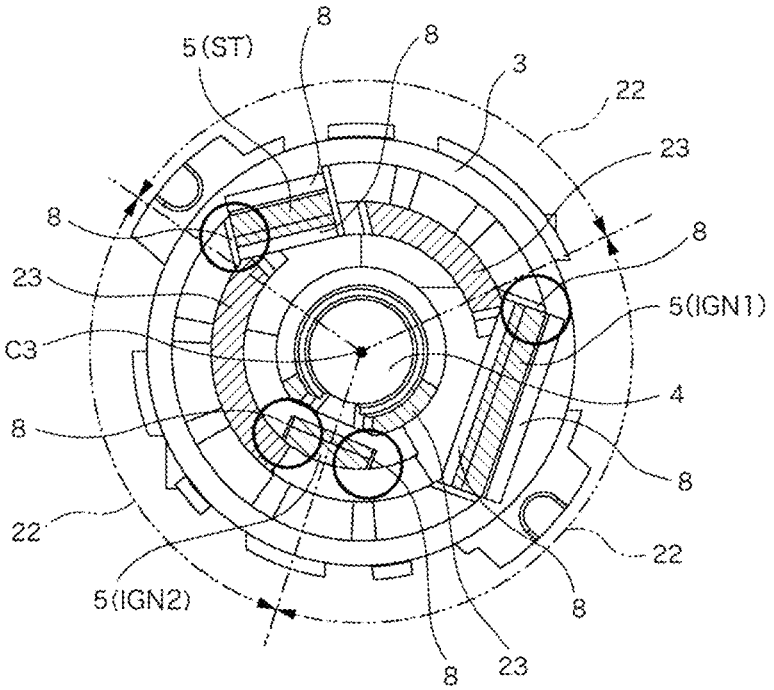
FIG. 3 is a view illustrating arrangement of fixed contacts.

As illustrated in FIG. 3, the power supply terminal 4 is formed in a circular shape, is connected to power supply (not illustrated), and is disposed at a center portion of the base portion 3, that is, a position of the rotation center (C3) of the rotation movable portion 1.

Figure 8:
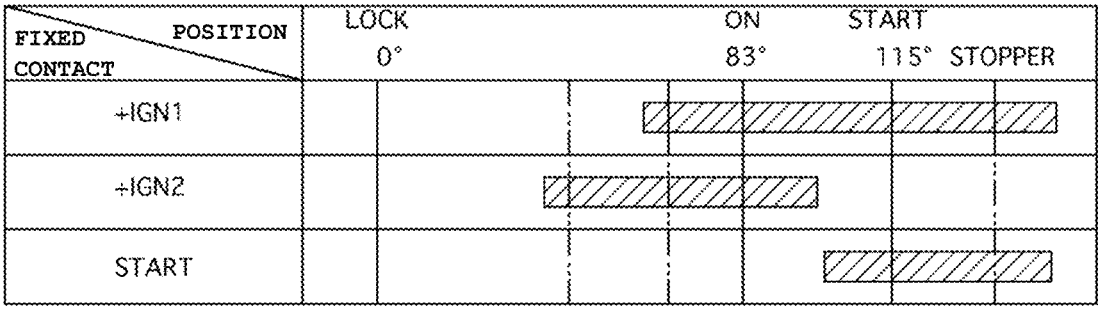
FIG. 8 is a chart illustrating a conduction state of a contact of the rotary switch.

In addition, as illustrated in FIG. 8, three fixed contacts 5 of +IGN1, +IGN2, and START, at which the connection with the power supply terminal 4 is sequentially switched when the plug is operated to rotate in order of the LOCK, ON, and START positions, are provided. First, during moving from the LOCK position to the ON position, the +IGN2 contact 5 (IGN2) is connected to the power supply terminal 4 and power is supplied to a +IGN2 terminal having the +IGN2 contact 5 (IGN2). Next, the +IGN1 contact 5 (IGN1) is connected to the power supply terminal 4 and power supply to a +IGN1 terminal is added. When the plug is moved to the ON position, power supply to both the +IGN1 terminal and the +IGN2 terminal is completed.

Thereafter, when the plug is operated to rotate from the ON position to the START position, first, the connection of the +IGN2 contact 5 (IGN2) with the power supply terminal 4 is released and power supply to the +IGN2 terminal is stopped. Next, a START contact 5 (ST) supplies power to a START terminal connected to the power supply terminal 4.

Power supply to the +IGN1 terminal is continued even by moving the plug to the START position and then power supply to the START terminal and the +IGN1 terminal is continued to a stroke end position.

As illustrated in FIG. 3, the three fixed contacts 5 described above are disposed on two concentric circles with respect to the center (C3) of the base portion 3. As illustrated in FIG. 8, an operation angle between the ON position and the START position is as small as substantially 30°. If the +IGN2 contact 5 (IGN2) and the START contact 5 (ST) which are in contact or separate at the ON position and the START position are disposed on the same circumference, the START contact 5 (ST) and the +IGN2 contact 5 (IGN2) are disposed on different concentric circles when considering that an interval between both contacts is shortened. That is, the START contact 5 (ST) and the +IGN2 contact 5 (IGN2) are disposed at positions where the shortest distance from the center (C3) of the base portion 3 is different.

Furthermore, the +IGN2 contact 5 (IGN2) is disposed on an inner circumference when considering that the number of occurrences of abrasion powder is large at the time of contacting or separating the contacts.

That is, abrasion powder at the time of contacting or separating the contacts is likely to occur at places (four places surrounded by bold circles in FIG. 3) where the contact transits from an OFF state to an ON state. In addition to moving the plug from the LOCK position to the START position, even when returning from the START position to the ON position, the opposite end is switched from the OFF state to the ON state and switching to the ON state occurs at both ends of the contact while the +IGN2 contact 5 (IGN2) has one contact point when another contact transits from the OFF state to the ON state.

From the above, since the number of occurrences of abrasion powder in the +IGN2 contact 5 (IGN2) is larger than that of other fixed contacts 5, the +IGN2 contact 5 (IGN2) is substantially separated from moving paths of the other fixed contacts 5 and thereby it is possible to effectively prevent deterioration of the entire insulation performance.

In addition, the fixed contacts 5 are respectively disposed such that the transition place from the OFF state to the ON state is uniformly distributed within a plurality of fan-shaped regions 22 of which apexes are the center of the base portion 3 and center angles are substantially equal to each other. In FIG. 3, boundaries of the fan-shaped regions 22 are indicated by chain lines.

Furthermore, as indicated by hatching in FIG. 3, a sliding bearing surface 23 is formed on the circumference on which each of the fixed contacts 5 is disposed. Each of the fixed contacts 5 is formed in a linear shape intersecting the sliding bearing surface 23 formed in an arc shape.

Since the sliding bearing surface 23 supports the movable contact 7 when the movable conductor 2 which is described below moves, the sliding bearing surface 23 is formed at a position higher than a height of each of the fixed contacts 5 so that contact with the fixed contact 5 can be performed smoothly. In addition, the power supply terminal 4, the fixed contact 5, and the sliding bearing surface 23 are formed such that surroundings thereof are surrounded by a concave portion 8.

In addition, the sliding bearing surface 23 which is formed on an inner circumference is formed to be lower in height than the sliding bearing surface 23 formed on an outer circumference and the movable contact 7 of the movable conductor 2 running on the sliding bearing surface formed on the outer circumference is not in contact with the fixed contact 5 and the sliding bearing surface 23 on the inside.

Figure 4:
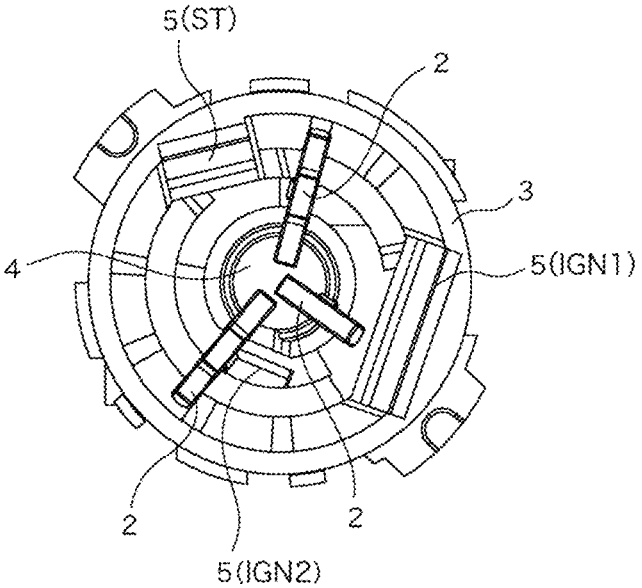
FIG. 4 is a view illustrating a position of a movable conductor at a LOCK position.
Figure 5:
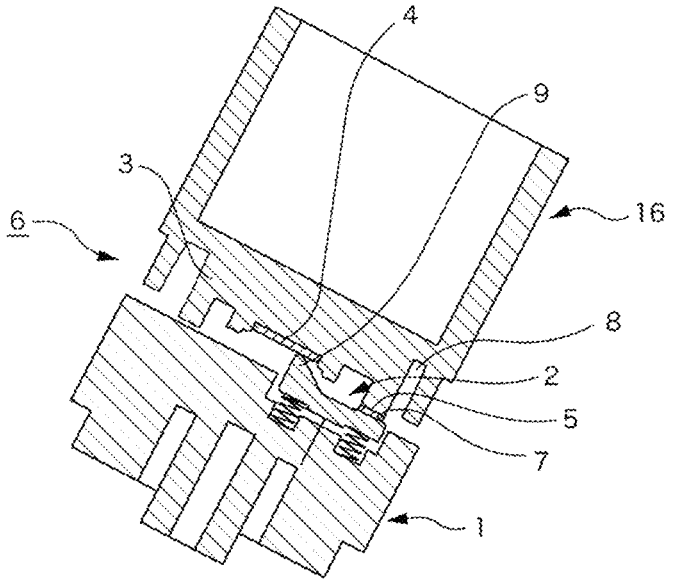
FIG. 5 is a sectional view illustrating a connection state between a power supply terminal and a fixed contact.

On the other hand, as illustrated in FIGS. 4 and 5, the same number of the movable conductors 2 as the number of the fixed contacts 5 is used and in the embodiment having three fixed contacts 5, three movable conductors 2 are used.

Each of the movable conductors 2 causes the power supply contact 9 to abut against the power supply terminal 4 of the base portion 3, the movable contact 7 to abut against the sliding bearing surface 23, and the power supply contact 9 and the movable contact 7 to be in pressed contact with the power supply terminal 4 and the sliding bearing surface 23 by the compression springs 21 in a state where the plug 11*a* is at the LOCK position.

Figure 6:
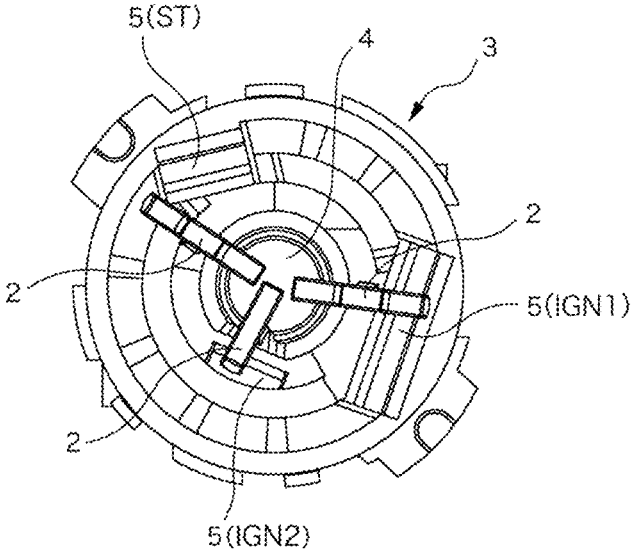
FIG. 6 is a view illustrating a position of the movable conductor at an ON position.

When the rotation movable portion 1 is rotated from this state to the ON position in the clockwise direction, as illustrated in FIG. 6, the +IGN1 and +IGN2 fixed contacts 5 are connected to the power supply terminal 4 via the movable conductor 2, and power is supplied to the +IGN1 and +IGN2 terminals. As described above, abrasion powder is likely to be generated at points of switching from OFF to ON of both the fixed contacts 5, that is, the contact start points of both the fixed contacts 5 due to use for a long period of time. However, the generated abrasion powder quickly falls into the concave portions 8 disposed at each contact start point, a side edge of the fixed contact 5, and a side edge of the sliding bearing surface 23. Therefore, dielectric breakdown or the like is prevented from occurring.

Figure 7:
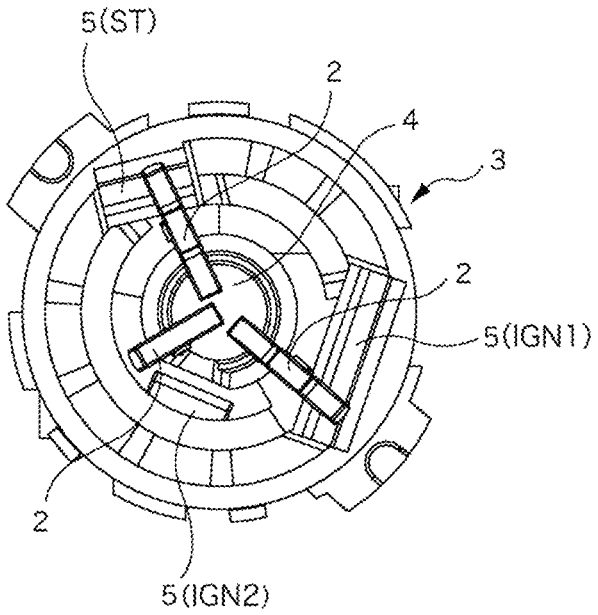
FIG. 7 is a view illustrating a position of the movable conductor at a START position.

When operating to rotate from the ON position to the START position, as illustrated in FIG. 7, only the contact of the +IGN2 contact 5 (IGN2) is released and then power is supplied to the +IGN2 terminal with the opposite end with respect to the contact start point as the contact start point in a forward path of the +IGN2 contact 5 (IGN2) again when returning to the ON position.

During the operation described above, the movable conductor 2 moves on the linear fixed contact 5 by an arcuate trajectory so that the movable conductor 2 operates so as to sweep abrasion powder on the fixed contact 5 by the movable conductor 2 and stagnation of abrasion powder on the fixed contact 5 is regulated.

This application is based on Japanese patent application (Japanese Patent Application No. 2015-103731) filed on May 21, 2015 and the contents of which are incorporated herein by reference.

REFERENCE SIGNS LIST

1 rotation movable portion
2 movable conductor
3 base portion
4 power supply terminal
5 fixed contact

6 rotary switch
7 movable contact
8 concave portion
9 power supply contact

The invention claimed is:

1. A rotary switch comprising:

a rotation movable portion;

a movable conductor held in rotation movable portion;

a base portion;

a power supply terminal held in the base portion; and a plurality of fixed contacts held in the base portion, wherein the fixed contact and the power supply terminal are connected and disconnected via the movable conductor by a rotational operation of the rotation movable portion, wherein the power supply terminal is disposed at a rotation center position of the rotation movable portion, wherein the plurality of fixed contacts are disposed at positions where the shortest distances from a rotation center of the rotation movable portion are different, wherein when the movable conductor and the plurality of fixed contacts are in contact with each other, switching is ON, when the movable conductor and the plurality of fixed contacts are separated from each other, switching is OFF, wherein the movable conductor includes a power supply contact in pressed contact with the power supply terminal at one end portion and a single movable contact at the other end portion, and wherein the shortest distances are distances between each of the fixed contacts and the rotation center of the rotation movable portion.

2. The rotary switch according to claim 1, wherein a movable contact, which is in contact with or separated from only the fixed contact corresponding to a rotation of the rotation movable portion, is provided in the movable conductor.

3. The rotary switch according to claim 1, wherein a concave portion is provided in the base portion to surround each of the fixed contacts.

4. The rotary switch according to claim 1, wherein a plurality of the movable conductors, including a power supply contact pressed to be in contact with the power supply terminal at one end portion and a single movable contact at the other end portion, are movably held in the rotation movable portion and independent with each other.

5. The rotary switch according to claim 2, wherein the movable contact has a predetermined length and each of the fixed contacts is formed in a linear shape.

6. The rotary switch according to claim 1, wherein the movable conductor includes a plurality of the movable conductors, and wherein the plurality of fixed contacts are respectively applied to the plurality of the movable conductors.

7. The rotary switch according to claim 1, wherein the movable conductor includes a plurality of the movable conductors, and wherein the plurality of the movable conductors are held in accommodation grooves formed in the rotation movable portion.

8. The rotary switch according to claim 1, wherein the movable conductor includes a plurality of the movable conductors, and wherein the plurality of the movable conductors are urged to a surface side of the base portion by the rotation movable portion.

9. The rotary switch according to claim 1, wherein the movable conductor includes a plurality of the movable conductors, and wherein each of the plurality of the movable conductors has a substantially linear shape.

* * * * *